United States Patent [19]

Liou

[11] 3,949,433

[45] Apr. 13, 1976

[54] DRAIN CLOSURE ASSEMBLY

[75] Inventor: Shu-Lien Liou, Taipei, China /Taiwan

[73] Assignee: Chin-Chih Chuang, Taipei, Taiwan, China /Taiwan; a part interest

[22] Filed: June 17, 1975

[21] Appl. No.: 587,672

Related U.S. Application Data

[63] Continuation of Ser. No. 421,353, Dec. 3, 1973, abandoned, which is a continuation-in-part of Ser. No. 189,209, Oct. 14, 1971, abandoned.

[52] U.S. Cl. ..... 4/295; 251/75; 251/323

[51] Int. Cl.[2] ..... A47K 1/14

[58] Field of Search ..... 4/191, 194, 204, 256, 287, 4/293, 295; 251/75, 263, 323

[56] References Cited

UNITED STATES PATENTS

| | | | |
|---|---|---|---|
| 423,698 | 3/1890 | Bechtold | 4/287 |
| 1,300,593 | 4/1919 | Fairchild | 4/295 |
| 1,403,423 | 1/1922 | LeDuc | 4/295 |
| 1,825,499 | 9/1931 | Zorn | 4/295 X |
| 2,186,625 | 1/1940 | Carroll | 4/295 |
| 2,683,551 | 7/1954 | Riveron | 4/295 X |
| 2,750,601 | 6/1956 | Houle | 4/295 |
| 2,915,762 | 12/1959 | Kivela | 4/295 |
| 2,968,047 | 1/1961 | Stilborn | 4/295 |
| 3,069,697 | 12/1962 | Brucken | 4/287 |
| 3,366,980 | 2/1968 | Petursson | 4/295 |
| 3,468,512 | 9/1969 | Politz | 4/295 X |
| 3,525,105 | 8/1970 | Richards | 4/287 |
| 3,537,113 | 11/1970 | Elzner | 4/256 |
| 3,588,928 | 6/1971 | Hiertz | 4/287 |
| 3,711,894 | 1/1973 | Gajer | 4/287 |
| 3,771,177 | 11/1970 | Rogers et al. | 4/287 |

FOREIGN PATENTS OR APPLICATIONS

| | | | |
|---|---|---|---|
| 713,668 | 8/1954 | United Kingdom | 4/295 |
| 1,001,532 | 8/1965 | United Kingdom | 4/295 |
| 22,152 | 6/1909 | United Kingdom | 4/287 |
| 994,089 | 6/1965 | United Kingdom | 4/295 |
| 12,645 | 1/1914 | United Kingdom | 4/295 |
| 172,326 | 8/1960 | Sweden | 4/295 |

*Primary Examiner*—Richard E. Aegerter
*Assistant Examiner*—Stuart S. Levy
*Attorney, Agent, or Firm*—Lane, Aitken, Dunner & Ziems

[57] ABSTRACT

A drain closure assembly including a resilient, dome-shaped plug member which may be changed from stable "closed" convex configuration to a stable "open" concave configuration by applying pressure to either an edge portion or a central portion of the plug member. The plug member is carried by a stem means which in the preferred embodiment is biased upwardly by spring means from a depressed position under the influence of pressure to a stable upper position when the pressure is released.

12 Claims, 4 Drawing Figures

DRAIN CLOSURE ASSEMBLY

This is a continuation, of application Ser. No. 421,353 filed Dec. 3, 1973 now abandoned, which, in turn, is a continuation-in-part of application Ser. No. 189,209, filed Oct. 14, 1971, now abandoned.

BACKGROUND OF THE INVENTION

This invention relates to a plug assembly for installation in liquid waste disposal units such as domestic wash basins, bath tubs and the like. In the past, drain closures for such units generally consisted of a socket portion and a plug which was designed with a tapered wall to permit its forced insertion into the socket where it remained secured in a friction bond with the walls of the socket until it was manually removed. Since the plug and the socket were separate elements, various means were provided for anchoring the plug, such as chains or other forms of fastening devices. In recent years the configuration of such plugs have changed in some instances to a dome type structure, but in all cases these structures are separate from a socket portion, maintain their original configuration, and require separate fastening devices to secure them within the socket to prevent drainage. U.S. Pat. No. 3,366,980 to Petursson represents a departure from the conventional type drain plug in that the plug and the socket are fastened together, the plug being provided with a pop-up feature which permits movement of the plug from a fully-opened position to a fully-closed position within the drain socket. Nevertheless, in order to maintain the plug or stopper in its closed position the patent requires a catch member. In addition the patent retains the concept of maintaining the plug in a single configuration; the plug simply being moved up and down between an open and closed position.

SUMMARY OF THE DISCLOSURE

A drain closure assembly has now been discovered for installation in a drain outlet comprising a socket member adapted to be fixedly secured to the outlet, the socket member including a drain to permit passage of waste liquid, a stem member supported in the socket member and axially movable relative thereto between a stable upper position and a depressed lower position, means, usually spring means, to restore the stem member from its depressed position to its upper position, a resilient, generally dome-shaped diaphragm plug member which is adapted to be carried by the stem member in each of two stable configurations. A first configuration assumes a convex shape wherein a circular edge of the plug member is in a substantially sealing relationship with a lip portion of the socket member. A second configuration is concave in form and permits a spaced relationship to exist between said lip portion and said circular edge sufficient to permit drainage through the socket member. The convex configuration is changed to the concave configuration by applying pressure to a central portion of the plug member so that that central portion is inverted and the stem member is depressed to its lowest position. Once pressure is removed the restoring or spring means biases the stem member to its stable upper position so that the plug member in its concave configuration is moved away from the lip portion of the socket member providing the aforesaid spaced relationship there-between. The plug member is readily restored to its convex configuration by applying pressure to an edge portion of the plug member.

Accordingly, it is an object of the present invention to provide a drain closure assembly of relatively simple design which may be economically produced and conveniently installed in wash basins, bath tubs and the like.

It is another object of the present invention to provide a drain closure assembly including a dome-shaped, diaphragm type drain plug which does not require a separate fastening device.

It is a further object of this invention to provide a drain closure assembly having a plug member which does not require separate means for securing it to a socket member in order to prevent drainage.

These and other objects of the present invention will become more apparent from the ensuing disclosure and appended claims.

DESCRIPTION OF THE PREFERRED EMBODIMENTS

Figure 1:
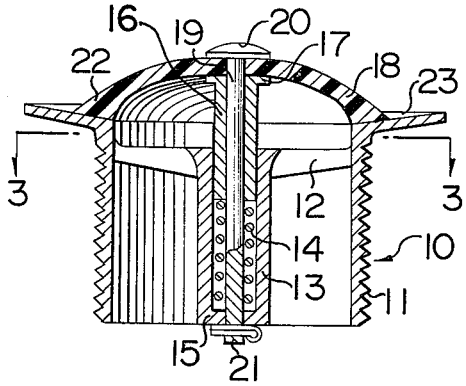
FIG. 1 is a sectional view of one embodiment of the invention showing the diaphragm plug member in its convex configuration whereby the drain is closed off.

The drain closure assembly according to this invention may be installed in a drain outlet, such as that of a domestic sink, with the upper flange or lip portion of the socket generally arranged flush with the bottom of the sink or other container. The assembly shown in FIG. 1 is in a fully-closed position. A hollow socket member generally designated 10 is threaded 11 on its outside surface to mate with those of a drain pipe not shown. The socket member is provided with a spider 12 which integrally carries thereon a hollow, axially extending shaft 13. Compression spring 14 is positioned within shaft 13 between a bottom portion 15 thereof and a hollow, axially extending sleeve 16 which is slideably mounted within shaft 13. Sleeve 16 has a top flange 17 which supports a dome-shaped resilient diaphragm plug 18. A stem 19 having a top cap portion 20 is inserted through a center hole in plug 18 and extends through sleeve 16, spring 14 and a hole in the bottom portion 15 of shaft 13. The lower end 21 of stem 19 is slotted or has a hole to accommodate a washer, snap ring, or cotter pin for the purpose of keeping the stem 19 within the shaft. The plug 18 is made of a flexible, elastic material including, for example, rubber or various types of plastic.

Figure 4:
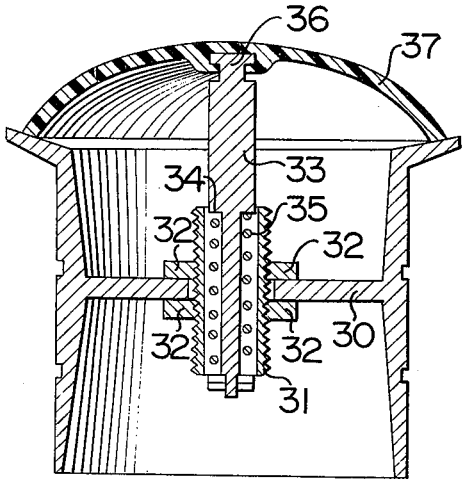
FIG. 4 depicts a second embodiment of the invention wherein the dome-shaped plug member has the same width throughout.

While the dome-shaped plug illustrated in FIG. 1 has a flared edge portion 22 it should be understood that this design is not absolutely necessary to the invention. As shown in FIG. 4, a dome-shaped plug having the same thickness throughout may also be used; the essential difference being in the height of the dome. If a low silhouette is preferred then the flared design will be necessary in order to insure the stability of the plug in each of its intended configurations.

In FIG. 1 the plug 18 is in a convex configuration so that its edge portion 22 is in a sealing relationship with a lip portion 23 of the socket 10 and prevents drainage of liquid therethrough. The liquid held within the basin or other container helps to establish this sealing relationship by exerting a hydraulic pressure on the plug thus holding its edge against the socket.

Figure 2:
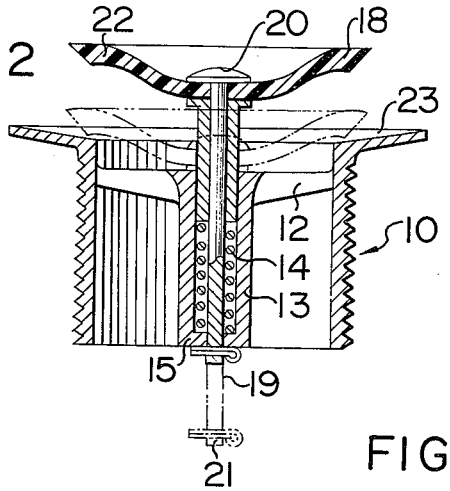
FIG. 2 illustrates the embodiment of FIG. 1 with the plug member in its concave configuration to permit drainage through the secret member.
Figure 3:
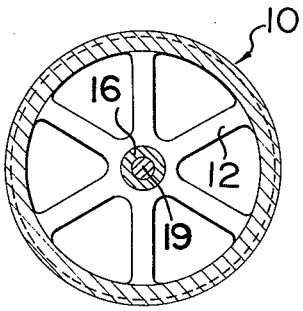
FIG. 3 is a top plan view along line 3—3 of the embodiment shown in FIG. 1.

In each of the stable configurations of the plug 18, the sleeve 16 simply rests on the spring 14. However, in changing the plug from the convex "stopping" configuration of FIG. 1 to the concave "open" configuration of FIG. 2, downward pressure is placed on a central portion of the plug, generally including the cap portion 20 of stem 19, so that the flexible dome is deformed to a stable concave form whereby the stem is depressed to its lower position as depicted in phantom in FIG. 2. Since sleeve 16 is also depressed within shaft 13 it compresses spring 14 so that when this pressure is removed the spring biases the sleeve upward, thus raising the stem to its stable upper position whereby the concave plug, carried by the stem, is moved away from the lip portion 23 of the socket. Thus, an opening is provided which permits drainage of liquid through the socket and into the drain pipe which is not shown.

The plug may be restored to its concave form simply by applying pressure to the circular edge of the plug without causing axial movement of the stem.

In FIG. 4 a second embodiment of the invention is shown in which the spider 30 is in a threaded relationship with shaft 31, the shaft being locked thereto by nuts 32. Stem 33 which is axially movable within shaft 30 is formed with a shoulder 34 which rests against spring 35. The top of stem 33 is a caphead 36 and is used to connect stem 33 to a dome-shaped resilient plug 37. The plug 37 is distinguished from that of FIG. 1 in that it has a higher dome construction and is of the same thickness throughout, in contrast to end-flanged configuration of the plug depicted in FIG. 1. However, its operation is essentially the same as the embodiment described above in connection with FIG. 1.

Any suitable materials, such as plastics, or metal, are used in forming the elements of the drain closure assembly of this invention. While specific reference has been made to a spring as a restoring means it should be understood what other materials such as a highly resilient rubber may be used in a similar manner. In addition, it should be clear that the placement of the restoring means is not limited to the embodiment illustrated, since it is intended for illustrative purposes only.

The above embodiments are to be considered in all respects as illustrative and not restrictive since the invention may be embodied in other specific forms without departing from its spirit or essential characteristics. Therefore, the scope of the invention is indicated by the claims rather than by the foregoing description, and all changes which come within the meaning and range of the equivalents of the claims are intended to be embraced therein.

I claim:

1. A drain closure assembly comprising:

a socket member adapted to extend at least partially within the drain to be closed and defining a through opening for permitting a liquid to flow into said drain, said socket member including a sealing surface;

a stopper member of a flexible material and having a substantially dome-shaped configuration substantially entirely across the entire surface thereof, an edge of said stopper member engaging the sealing surface of said socket member in a sealing relationship to inhibit a flow of liquid into said drain when said stopper member is in a closed position;

means, including a support member secured to said stopper member and slideable relative to said socket member, for supporting said stopper member in cooperation with said socket member in a position extending over said opening and in engagement with said socket member to seal said opening;

said stopper member being structurally adapted to flex to an inverted position out of engagement with said sealing surface of said socket member in response to an external force acting on said stopper member to release said seal and to flex from said inverted position back to said substantially dome-shaped configuration in response to an additional external force acting therein without accompanying axial movement of said support means;

means for urging said stopper member in a direction away from said socket member when said external force is released; and means for limiting the movement of said support member when said stopper means is urged from said socket member.

2. A drain closure assembly as defined in claim 1 wherein said stopper member is flared at its edges.

3. A drain closure assembly as defined in claim 1 wherein said stopper member is of substantially the same thickness throughout.

4. The assembly of claim 1 wherein said stopper member is structurally adapted to snap to and from said inverted position in response to said external force.

5. The assembly of claim 1 wherein said supporting member comprises a rod coaxially mounted in said socket member and secured to said stopper member.

6. A drain closure assembly as defined in claim 5 wherein said socket member includes a hollow, axially extending shaft member integrally formed within said socket member, said rod being supported in and extending through said shaft member.

7. A drain closure assembly as defined in claim 5 wherein said shaft member and said socket member are not integrally formed but said shaft member is fixedly secured within said socket member.

8. The assembly of claim 5 wherein one end portion of said rod extends through a central opening formed in said stopper member.

9. The assembly of claim 5 wherein said rod is slideably mounted relative to said socket member and wherein said means for urging said stopper member comprises a spring in operative engagement with said rod.

10. The assembly of claim 9 wherein said external force is a manual pressure applied against said rod in a direction opposite to that of said force applied by said spring.

11. The assembly as set forth in claim 1 wherein said stopper member includes an elastomeric diaphragm member which has a convex cross-sectional configuration when the edge thereof is sealingly engaged with the sealing surface of said socket member, said elastomeric diaphragm member having a resiliency and rigidity which permits said diaphragm member to be inverted to a concave cross sectional configuration when said stopper member is in an open position by pressing the central portion of said diaphragm member which is secured to said slideable support member, said diaphragm member being capable of being restored to said convex configuration from said concave configuration without slideable movement of said support member by pressing an edge portion of said diaphragm member.

12. The assembly as set forth in claim 11 wherein the cooperation of said supporting means and said diaphragm member is such that a connection between said support member and said diaphragm member is at the same level for both the open and closed position of said diaphragm member.

* * * * *